United States Patent [19]

Oswald

[11] 4,213,418

[45] Jul. 22, 1980

[54] ENLONGATED BAR SUPPORT MEANS FOR THE SPRAY COATING AND CONVEYING OF DRUM PARTS

[75] Inventor: Donald E. Oswald, Foster City, Calif.

[73] Assignee: Kaiser Steel Corporation, Oakland, Calif.

[21] Appl. No.: 885,773

[22] Filed: Mar. 13, 1978

[51] Int. Cl.[2] ..... B05B 5/02

[52] U.S. Cl. ..... 118/635; 118/500; 118/501; 248/340; 248/312.1; 269/8; 198/652

[58] Field of Search ..... 118/500, 501, 502, 503, 118/630-635; 248/311.1 A, 340; 198/652; 269/8; 294/5.5

[56] References Cited

U.S. PATENT DOCUMENTS

| | | | |
|---|---|---|---|
| 807,517 | 12/1905 | Vance | 269/8 |
| 1,005,870 | 10/1911 | Packer | 248/340 |
| 2,729,191 | 1/1956 | Ransberg | 118/500 |
| 2,967,691 | 1/1961 | Lehnbeuter et al. | 248/311.1 A |

*Primary Examiner*—John D. Welsh

*Attorney, Agent, or Firm*—Naylor, Neal & Uilkema

[57] ABSTRACT

Drum parts, i.e. heads, bottoms and lids, are conveyed through pre-treatment, resin powder spray, and resin curing stations by a monorail conveyor system which has improved hold down means and shield means to prevent the parts from swinging and to prevent the outer side of the parts from being coated.

2 Claims, 4 Drawing Figures

ENLONGATED BAR SUPPORT MEANS FOR THE SPRAY COATING AND CONVEYING OF DRUM PARTS

SUMMARY OF THE INVENTION

The present invention is particularly useful to hang the heads, bottoms and lids of drums in a vertical plane and to stably support them while they are coated with resin powder electrostatically. This is done in a powder booth in which, for example, four electrostatic powder guns are reciprocated up and down in timed relation with the speed of the monorail conveyor to expose the parts to the same amount of powder. The monorail conveyor and the improved parts hanging and shielding means thereof are connected to ground while the powder issuing from the spray guns has a relatively high electrostatic charge. Only the eventual drum-inside sides of the parts are intended to be coated but the difference in electrostatic potential between the powder spray and the parts causes undesirable coating of the back sides of the parts because of the over-spray attracted thereto.

An object of the invention is to provide a simple and improved parts hanger system whereby the parts can be quickly and efficiently attached to the monorail conveyor and removed therefrom while at the same time the parts are prevented from any swing or sway under the influence of either the powder spray or movement of the conveyor.

Another object of the invention is to provide such an improved parts hanger system with grounded over-spray shield means to protect the back sides of the parts from receiving a powder coating.

DESCRIPTION OF THE INVENTION

These and other objects and advantages of the invention will be apparent from the following description taken in conjunction with the drawings forming part of this specification, and in which.

The monorail conveyor comprises monorail 10, monorail trolley 12 supported from wheels 14, and a bar 16, preferably made of square bar stock, suspended from the trolley 12. The bar 16 has attached to it the various means for carrying the drum head, bottom and lid parts.

Figure 2:
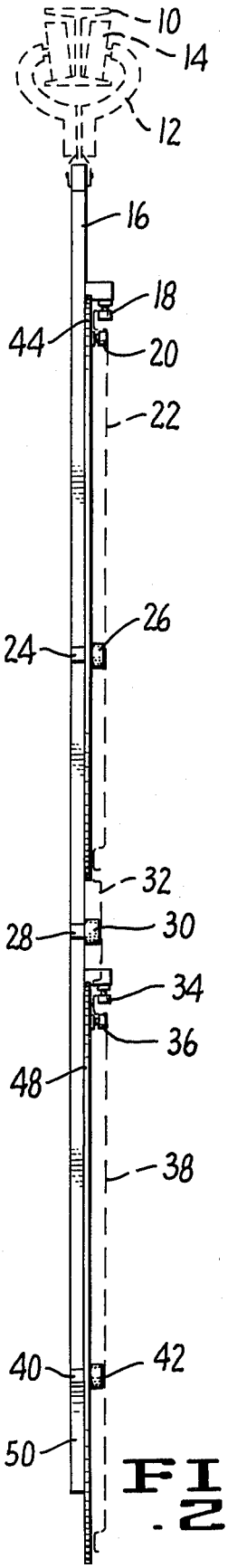
FIG. 2 is a view in side elevation of the conveyor of FIG. 1.
Figure 1:
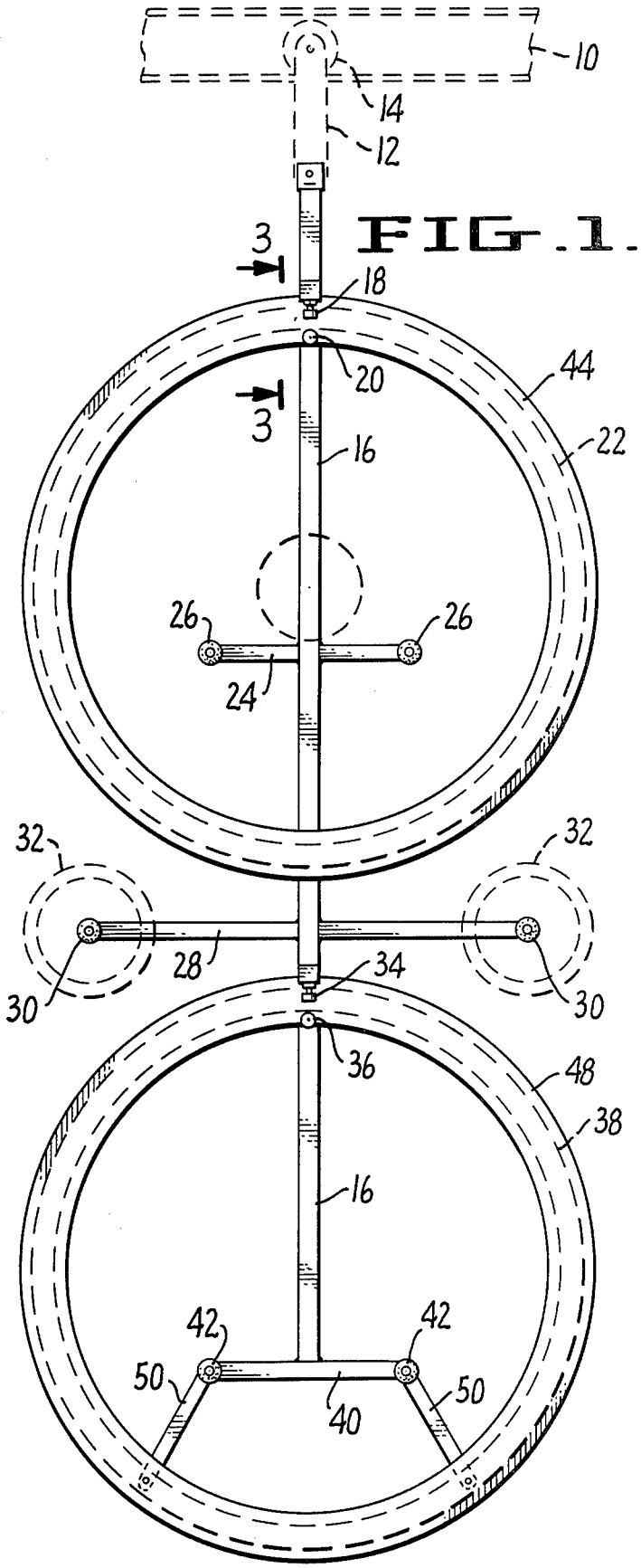
FIG. 1 is a view in front elevation of the improved parts hanging and shielding means of the invention.
Figure 3:
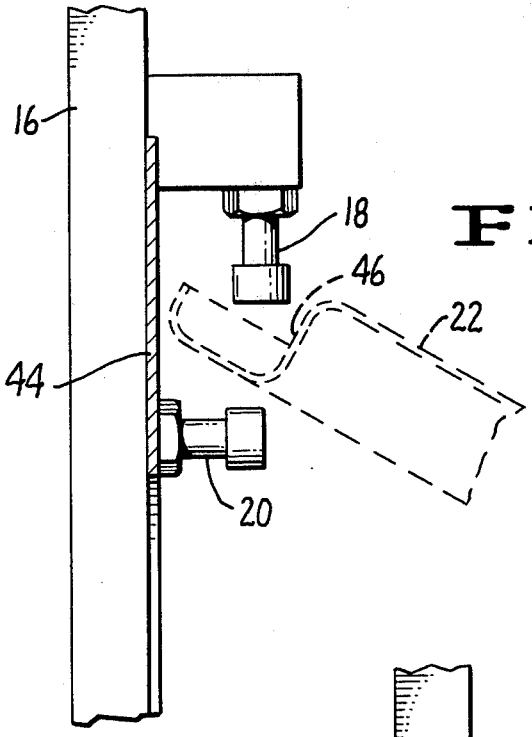
FIG. 3 is an enlarged detail view taken along lines 3—3 of FIG. 1, a drum head being shown in dotted outline in the process of being connected to the parts hanger for support.
Figure 4:
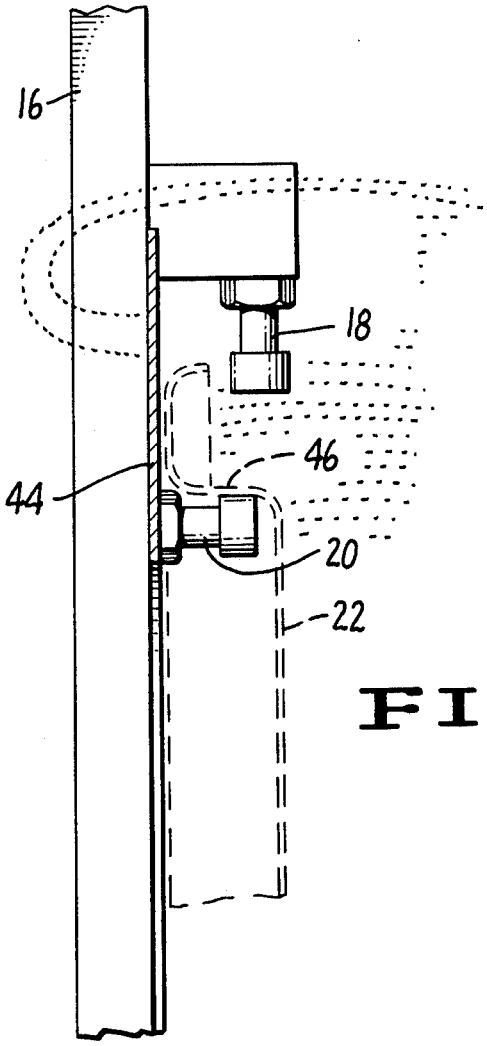
FIG. 4 is a view similar to that of FIG. 3, showing the drum head in dotted outline in completely connected relation to the parts hanger.

The drum head support means comprises a pair of cap screws 18 and 20. A drum head 22 is connected to the conveyor by the cap screws 18 and 20 in the manner indicated by FIGS. 3 and 4. The bar 16 carries a cross bar 24 which carries a pair of magnets 26. The magnets bear against the drum head and serve to magnetically retain the head in place against any swinging or swaying movement during the course of the powder spray application or before and after during the course of conveyor movement.

The drum lid or cap support means comprises a cross bar 28 attached to the bar 16 and a pair of magnets 30 attached to the bar 28. The lids or caps 32, normally one per drum, are supported solely by the magnetic attraction afforded by the magnets.

The drum bottom support means is comprised of a pair of cap screws 34 and 36 which are the same as the cap screw pair 18, 20 and serve to hold and retain a drum bottom 38 in the same way as the latter hold and retain a drum head 22. The drum bottom support means further comprises a cross bar 40 carried by the bar 16 and a pair of magnets 42 carried by the bar 40, the magnets bearing against and serving to magnetically hold the drum bottom to prevent any swinging or swaying thereof during powder spray application or conveyor movement.

The improved parts hanger consisting of electrically conductive material comprises over-spray shield means for both the drum head and the drum bottom. The over-spray shield for the drum head consists of a ring 44 which is attached to the bar 16. The ring has an outer diameter greater than that of the drum head and an inner diameter which is less than the diameter of the shoulder 46 of the drum head. The over-spray shield for the drum bottom consists of a similar ring 48 which is similarly related in size to the drum bottom 38. In addition to being supported by rod 16, ring 48 is carried by bar elements 50 which are attached to cross bar 40.

All of the described parts of the hanger system are connected to ground potential. Thus the electrostatically charged over-spray powder is prevented from reaching the grounded back sides of the drum head and drum bottom parts and is instead collected by the two grounded ring members 44 and 48. When the over-spray build-up on the rings tends to insulate their collector surfaces from a connection with ground potential, the coatings are removed from the rings by scraping or burning.

What is claimed is:

1. Support means to stably position a drum end, having a peripheral axial shoulder and radial flange, vertically for the application thereto of a coating material comprising an elongated bar and means to dispose the bar in a vertical position, hanger means carried by the bar to receive and retain the peripheral edge of the drum end, a cross-member carried by the bar below said hanger means, magnet means carried by the cross-member to engage the drum end and in conjunction with said hanger means stationarily position the drum end in a generally vertical plane for the application thereto of coating material, an annular back-up member for said drum end secured to said bar, said member being positioned substantially concentrically with respect to a drum end positioned on such support means and having an outer diameter greater than the diameter of the drum end and an inner diameter less than the peripheral shoulder of the drum end, all of said parts being formed of electrical conductor material and being connected to ground, whereby said back-up member functions as an over-spray shield to prevent the deposition of electrostatically charged coating material onto the shoulder and flange area of the drum end adjacently disposed to the back-up member.

2. The combination of claim 1, said means to dispose the bar in a vertical position including a monorail and a monorail trolley disposed in connected and supporting relation to the bar.

* * * * *